US005476264A

United States Patent [19]

Ortega

[11] Patent Number: 5,476,264

[45] Date of Patent: Dec. 19, 1995

[54] QUEST AND BATTLE BOARD GAME

[76] Inventor: Lori J. Ortega, 724 Francis Ct. #7, Sun Prairie, Wis. 53590

[21] Appl. No.: 432,461

[22] Filed: May 1, 1995

[51] Int. Cl.[6] ..... A63F 3/00

[52] U.S. Cl. ..... 273/255; 273/284; 273/287

[58] Field of Search ..... 273/236, 242, 273/243, 251, 252, 254, 255, 262, 284, 287

[56] References Cited

U.S. PATENT DOCUMENTS

| | | | |
|---|---|---|---|
| 1,367,261 | 2/1921 | Hudon | 273/255 |
| 2,273,292 | 2/1942 | Smith | 273/255 |
| 4,200,293 | 4/1980 | Benson, III | 273/288 X |
| 4,415,160 | 11/1983 | Lamb | 273/255 X |
| 4,712,673 | 12/1987 | Moore | 273/287 X |
| 5,004,246 | 4/1991 | Merrill et al. | 273/287 X |
| 5,118,115 | 6/1992 | Codinha | 273/255 |
| 5,380,013 | 1/1995 | Nacht | 273/287 |

*Primary Examiner*—William E. Stoll

[57] ABSTRACT

A quest and battle board game comprising: a game board formed in a planar configuration and including a maze and battle side and a world map side, the maze and battle side including a plurality of rectangular spaces and a plurality of upwardly extending structures representing mazes, the world map side being formed in a planar configuration and including a plurality of inverted V-shaped structures, the world map side also including house-shaped structures, castle-shaped structures, circled numerals and other structures providing for organized movement of pieces across the board; and a plurality of character cards including information regarding the abilities of the characters of the game, at least one handbook being included with the apparatus, the handbooks providing background information and detailed instructions regarding play of the game, the game including player pieces and a random number generating device to determine movement of the pieces.

6 Claims, 4 Drawing Sheets

18

HERO, PRINCE AGRETO

| STARTING ATTRIBUTES, | W.A.SH.H |
|---|---|
| HP,-30 | STAFF |
| MP,-25 | ROBE |
| STR,-1 ATTACK DIE | BAR HELMET |
| IQ,-1 DEFEND DIE | |
| MOVE,-5 SPACES | ITEMS |
| GOLD,-75 | STONE OF WATER |

QUEST AND BATTLE BOARD GAME

BACKGROUND OF THE INVENTION

1. Field of the Invention

The present invention relates to a quest and battle board game and more particularly pertains to successfully accomplishing a series of quests to receive items in preparation for a final battle with the enemy.

2. Description of the Prior Art

The use of board games is known in the prior art. More specifically, board games heretofore devised and utilized for the purpose of entertaining users by playing the games in the suggested manner are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 5,211,402 to Ferguson an analogies board game.

U.S. Pat. No. 5,251,905 to Bombino discloses a method for playing war game.

U.S. Pat. No. 3,989,254 to Cooper discloses a battle board game apparatus.

U.S. Pat. No. 5,139,266 to Mullins discloses a world tour board game.

Lastly, U.S. Pat. No. 4,332,385 to McCaslin discloses a game with moveable maze on game board.

In this respect, the quest and battle board game according to the present invention substantially departs from the conventional concepts and designs of the prior art, and in doing so provides an apparatus primarily developed for the purpose of successfully accomplishing a series of quests to receive items in preparation for a final battle with the enemy.

Therefore, it can be appreciated that there exists a continuing need for a new and improved quest and battle board game which can be used for successfully accomplishing a series of quests to receive items in preparation for a final battle with the enemy. In this regard, the present invention substantially fulfills this need.

SUMMARY OF THE INVENTION

In view of the foregoing disadvantages inherent in the known types of board games now present in the prior art, the present invention provides an improved quest and battle board game. As such, the general purpose of the present invention, which will be described subsequently in greater detail, is to provide a new and improved quest and battle board game and method which has all the advantages of the prior art and none of the disadvantages.

To attain this, the present invention essentially comprises a game board formed in a planar generally rectangular configuration and including a maze and battle side and a world map side, the maze and battle side having a maze half and a battle half, the battle half being formed in a generally rectangular configuration and including a rectangular central region comprising about one hundred and thirty rectangular spaces, the maze half including about five hundred and twenty rectangular spaces and a plurality of upwardly extending box-like structures representing mazes, the mazes being positioned sporadically throughout the maze half of the game board, two walkways formed in a long narrow configuration being positioned perpendicular to the long edges of the maze half, a generally rectangular shaped multiply lined area being positioned adjacent to a corner of the maze half; a world map side of the game board, the world map side being formed in a generally rectangular configuration, the world map side being divided into a plurality of generally circular shaped regions of differing sizes by curved blank paths positioned between them, the world map side including a plurality of inverted V-shaped structures positioned in groups sporadically throughout the two largest regions, a plurality of house-shaped structures and castle-shaped structures positioned adjacent to the inverted V-shaped structures, a plurality of circled numerals being positioned within each region, a plurality of contiguous rectangular shaped structures being positioned around the numerals in various areas of the two largest regions; the apparatus including a plurality of character cards, the character cards including various information pertaining to the individual characters of the game, a plurality of handbooks being included with the apparatus, a first handbook being titled THE QUEST OF EFIL PLAYERS HANDBOOK, the first handbook providing background information and detailed instructions regarding play of the game, a second handbook being titled ZAL'S HANDBOOK, the second book describing the abilities of Zal, the most powerful character of the game, the third handbook being titled TOWNS & MAZES, the third handbook describing the requirements for successfully traversing the mazes, quests and other obstacles of the game, the game including a plurality of castle holders, the castle holders shaped in the configuration of a mythical dragon with a circular base unit, the circular base unit permitting the castle holder to be easily moved from one location to another on the game board, a first six sided die and a second six sided die, the first die including the numerals 1 through 6, the second die including the numerals 7 through 12, players rolling each die to determine movement of their respective pieces.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved quest and battle board game which has all of the advantages of the prior art board games and none of the disadvantages.

It is another object of the present invention to provide a new and improved quest and battle board game which may be easily and efficiently manufactured and marketed.

It is further object of the present invention to provide a new and improved quest and battle board game which is of durable and reliable constructions.

An even further object of the present invention is to provide a new and improved quest and battle board game which is susceptible of a low cost of manufacture with regard to both materials and labor, and which accordingly is then susceptible of low prices of sale to the consuming public, thereby making such quest and battle board game economically available to the buying public.

Still yet another object of the present invention is to provide a new and improved quest and battle board game which provides in the apparatuses and methods of the prior art some of the advantages thereof, while simultaneously overcoming some of the disadvantages normally associated therewith.

Still another object of the present invention is to successfully accomplish a series of quests to receive items in preparation for a final battle with the enemy.

Lastly, it is an object of the present invention to provide a new and improved a quest and battle board game comprising: a game board formed in a planar configuration and including a maze and battle side and a world map side, the maze and battle side including a plurality of rectangular spaces and a plurality of upwardly extending structures representing mazes, the world map side being formed in a planar configuration and including a plurality of inverted V-shaped structures, the world map side also including house-shaped structures, castle-shaped structures, circled numerals and other structures providing for organized movement of pieces across the board; and a plurality of character cards including information regarding the abilities of the characters of the game, at least one handbook being included with the apparatus, the handbooks providing background information and detailed instructions regarding play of the game, the game including player pieces and a random number generating device to determine movement of the pieces.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
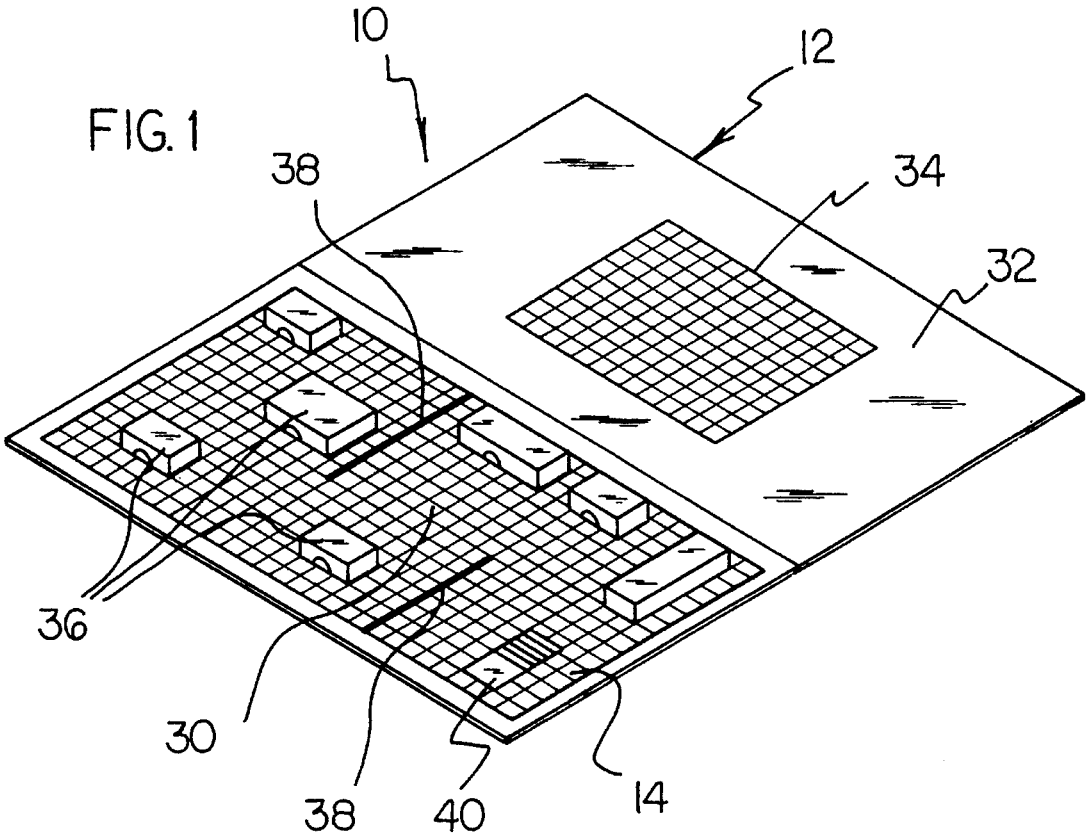
FIG. 1 is a perspective view of the maze and battle side of the quest and battle board game constructed in accordance with the principles of the present invention and illustrating the maze and battle side of the game board.

With reference now to the drawings, and in particular to FIG. 1 thereof, the preferred embodiment of the new and improved quest and battle board game embodying the principles and concepts of the present invention and generally designated by the reference numeral 10 will be described.

The present invention, the quest and battle board game 10 is comprised of a plurality of components. Such components in their broadest context include a game board 12, character cards 18, three handbooks 24, and character game pieces 26. Such components are individually configured and correlated with respect to each other so as to attain the desired objective.

Figure 2:
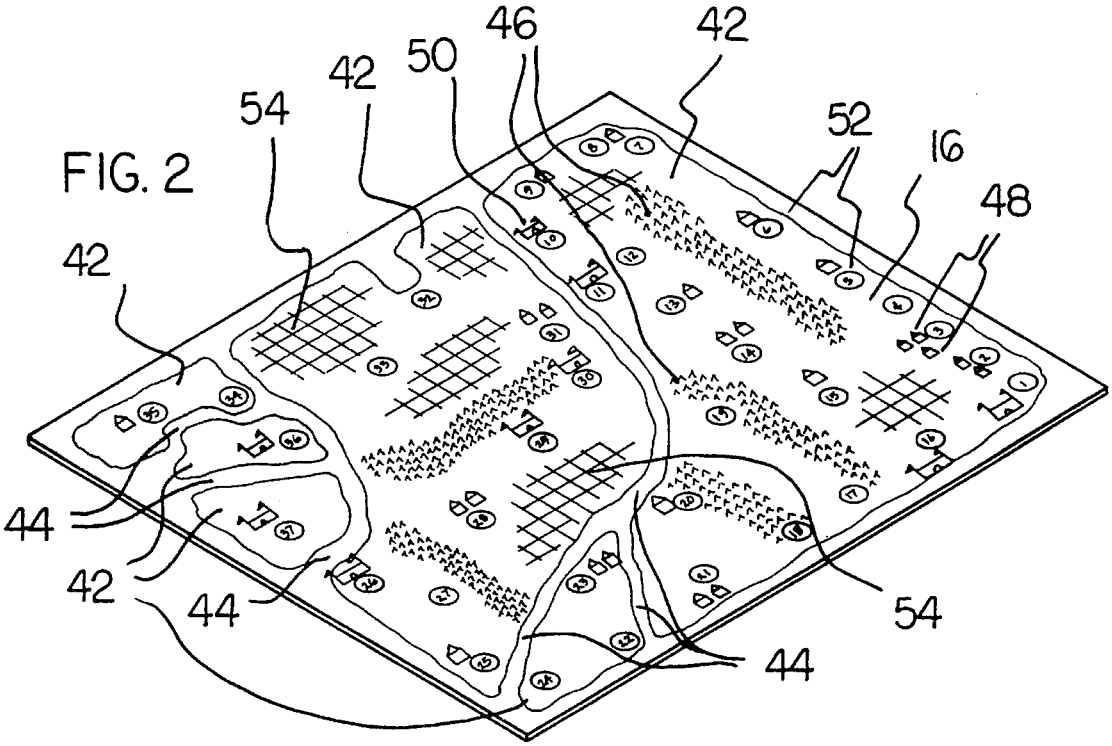
FIG. 2 is a perspective view of the world map side of the game board of the apparatus.

More specifically, the game board 12 is formed in a planar generally rectangular configuration and includes a maze and battle side 14 and a world map side 16. The different sides of the game board permit players to play different versions of the game when desired. To switch from one version of the game to the other the user simply flips the board over and plays according to the rules of the chosen side of the board. Note FIGS. 1 and 2.

The maze and battle side of the game board has a maze half 30 and a battle half 32. The battle half is formed in a generally rectangular configuration and includes a rectangular central region 34 comprising about one hundred and thirty rectangular spaces. The rectangular spaces are surrounded by a white border. The maze half 30 includes about five hundred and twenty rectangular spaces and a plurality of upwardly extending box-like structures 36 representing mazes. The mazes are a critical component of the game. They are entered by the players in order to engage in the various quests of the game. The mazes are positioned sporadically throughout the maze half of the game board. Two walkways 38 are formed in a long narrow configuration which are positioned perpendicular to the long edges of the maze half. A generally rectangular shaped multiply lined area 40 is positioned adjacent to a corner of the maze half. Note FIG. 1.

A world map side 16 is located on the reverse side of the board with respect to the maze and battle side. The world map side 16 is formed in a generally rectangular configuration. The world map side 16 is divided into a plurality of generally circular shaped regions 42 of differing sizes by curved blank paths 44 positioned between them. The paths divide the game into large and small regions. In the preferred embodiment the apparatus includes two very large regions and four small regions. A central path is formed in a generally Y-shaped orientation with an end fork. A first fork member is positioned in a corner of the board and a second fork member is positioned adjacent to that corner. The area between the forks defines a small circular shaped region. Note FIG. 2.

The world map side 16 includes a plurality of inverted V-shaped structures 46 positioned in groups sporadically throughout the two largest regions. There are approximately one thousand and forty V-shaped structures in the preferred embodiment of the game. A plurality of house-shaped structures 48 and castle-shaped structures 50 are positioned adjacent to the inverted V-shaped structures. A plurality of circled numerals 52 are positioned within each region. A plurality of contiguous rectangular shaped structures 54 are positioned around the numerals in various areas of the two largest regions. The numerals and various structures are organized to provide a regimented path throughout the game. Players engage in a variety of quests while traversing the different regions of the game. Note FIG. 2.

Figures 5, 6:
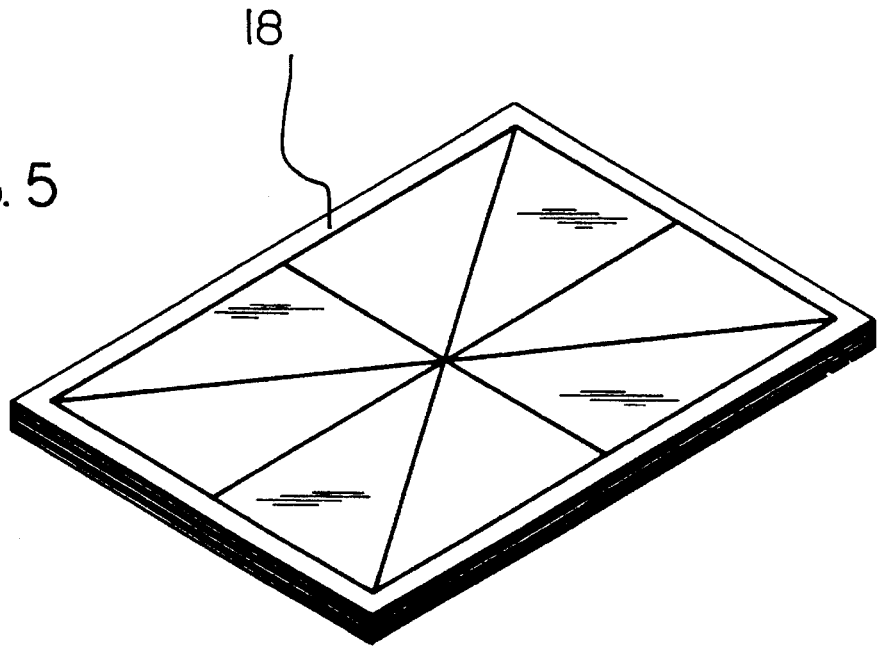
FIG. 5 is a perspective view of the character cards of the apparatus positioned in a face down orientation.
FIG. 6 is a perspective view of a character card of the apparatus positioned in a face up orientation with a plurality of game related indicia printed thereupon.
Figure 7:
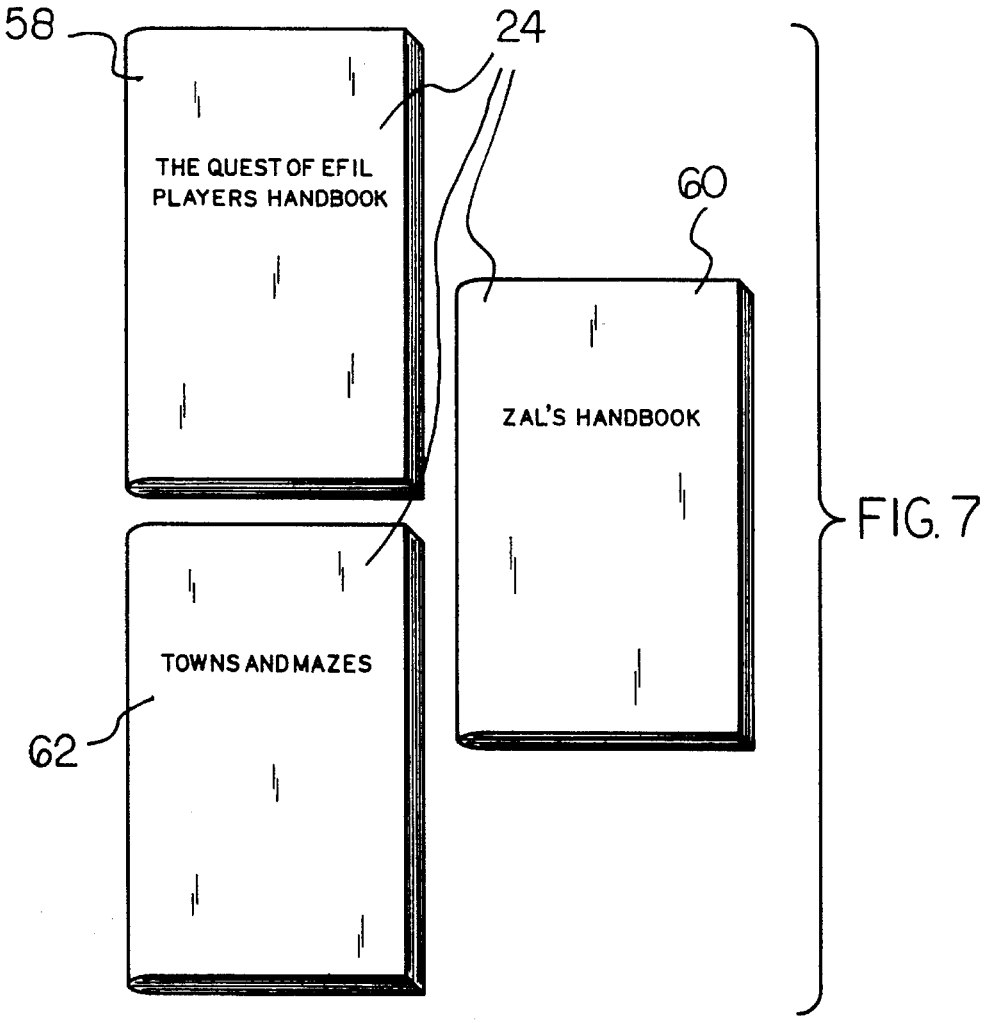
FIG. 7 is a perspective view of the three handbooks of the apparatus.

The apparatus includes a plurality of character cards 18. The character cards include various information pertaining to the individual characters of the game. Each character card includes starting attributes and a listing of some of the various garments worn by the character. The characters of the game are as follows: Hero, Prince Agreto; Wizard, Selia; Master Thief, Ras; King of Dwarves, Malzax; Cyborg, Tal-700; Ninja, Talmar*Kalmi. A plurality of handbooks 24 are included with the apparatus. All of the handbooks are formed with bindings like a standard book. The title of each respective book is positioned in capital letters across the front cover. In the preferred embodiment the handbooks are uniformly sized and include varying numbers of pages. In one embodiment of the apparatus the game includes a conveniently sized box to house the various components of the apparatus. Note FIGS. 5 and 6.

The first handbook 58 is titled THE QUEST OF EFIL PLAYERS HANDBOOK. The first handbook provides background information and detailed instructions regarding play of the game. Some of the topics covered in THE QUEST OF EFIL PLAYERS HANDBOOK are as follows: a beginning story, weapons, armor, shields and helmets, spells, movement and movement in battle, entering a maze, town, room or castle, etc. The second handbook 60 is titled ZAL'S HANDBOOK. The second book describes the abilities of Zal, the most powerful character of the game. The handbook titled ZAL'S HANDBOOK includes some of the following subjects: Zal's directions and info on game play, castle of riddles, Tal-700, spells, monsters, cursed weapons, etc. The third handbook 62 is titled TOWNS & MAZES. The third handbook describes the requirements for successfully traversing the mazes, quests and other obstacles of the game. The handbook entitled TOWNS & MAZES includes some of the following subjects: information on maze movement, entrance to Divetower, troll trees, Tower of Flight, Volcano of Burning Ice, Island of Treasure, Vulture Desert, etc.

Figure 3:
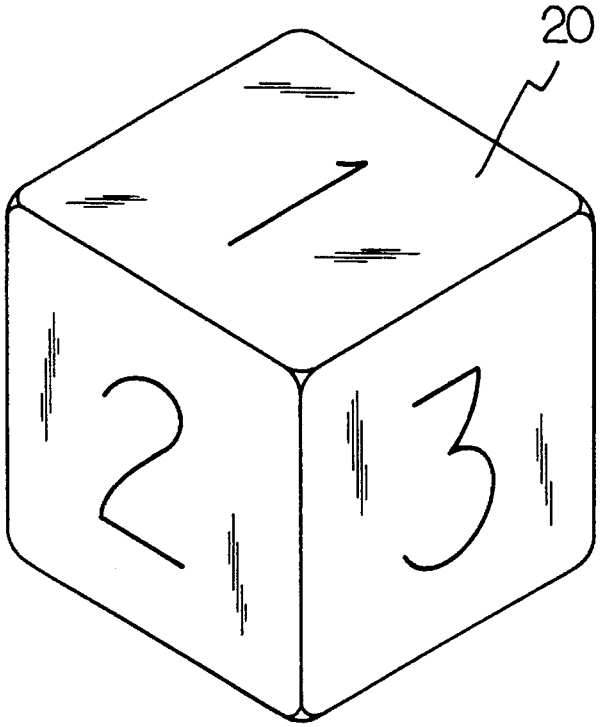
FIG. 3 is a perspective view of the die numbered one through six.
Figure 4:
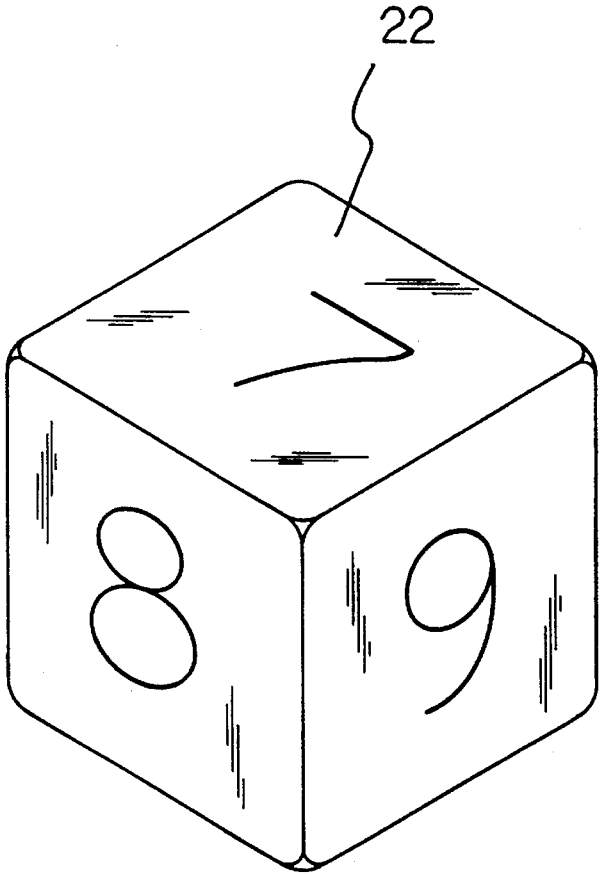
FIG. 4 is a perspective view of the die numbered seven through twelve.
Figure 8:
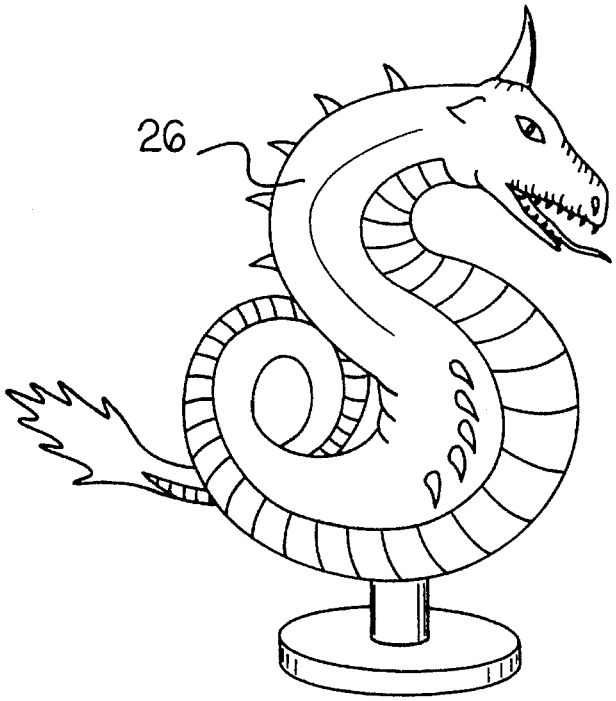
FIG. 8 is a perspective of the castle holder game piece of the apparatus.

The game includes a plurality of castle holders 26. The castle holders are shaped in the configuration of a mythical dragon with a circular base unit. The circular base unit permits the castle holder to be easily moved from one location to another on the game board. During play of the game individual players move their respective castle holders to various locations on the board according to their dice rolls. In the preferred embodiment the castle holders are fabricated in a variety of Colors to allow players to choose their favorite color. A first six sided die 20 and a second six sided die 22 are included. The first die includes the numerals 1 through 6. The second die includes the numerals 7 through 12. Players roll each die to determine movement of their respective pieces. The dice are also rolled when engaging in one of the many quests of the game. Note FIGS. 3, 4 and 8.

The game is adapted to be played by between one and seven players. Play of the game takes place through a series of quests. The quests have to be played in order to receive items for defeating the enemy at the last battle. One of the advantages of the game is that the instructions are easy to understand. The game is long in duration but the quests are very different from each other, making the game interesting all the way through. Anyone from age ten to adult will find game play straight forward, without having to constantly return to the instruction booklet to look up rules. Players can gain different levels for Hit Points and Magic Spells. Players encounter different monsters to fight depending on the area the player is in. A large variety of weapons and armor vary throughout the game.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved quest and battle board game comprising, in combination:

a game board formed in a planar generally rectangular configuration and including a maze and battle side and a world map side, the maze and battle side having a maze half and a battle half, the battle half being formed in a generally rectangular configuration and including a rectangular central region comprising about one hundred and thirty rectangular spaces, the maze half including about five hundred and twenty rectangular spaces and a plurality of upwardly extending box-like structures representing mazes, the mazes being positioned sporadically throughout the maze half of the game board, two walkways formed in a long narrow configuration being positioned perpendicular to the long edges of the maze half, a generally rectangular shaped multiply lined area being positioned adjacent to a corner of the maze half;

a world map side of the game board, the world map side being formed in a generally rectangular configuration, the world map side being divided into a plurality of generally circular shaped regions of differing sizes by curved blank paths positioned between them, the world map side including a plurality of inverted V-shaped structures positioned in groups sporadically throughout the two largest regions, a plurality of house-shaped structures and castle-shaped structures positioned adjacent to the inverted V-shaped structures, a plurality of circled numerals being positioned within each region, a plurality of contiguous rectangular shaped structures being positioned around the numerals in various areas of the two largest regions;

the apparatus including a plurality of character cards, the character cards including various information pertaining to the individual characters of the game, a plurality of handbooks being included with the apparatus, a first handbook being titled THE QUEST OF EFIL PLAYERS HANDBOOK, the first handbook providing background information and detailed instructions regarding play of the game, a second handbook being titled ZAL'S HANDBOOK, the second book describing the abilities of Zal, the most powerful character of the game, the third handbook being titled TOWNS & MAZES, the third handbook describing the requirements for successfully traversing the mazes, quests and other obstacles of the game, the game including a plurality of castle holders, the castle holders shaped in the configuration of a mythical dragon with a circular base unit, the circular base unit permitting the castle holder to be easily moved from one location to another on the game board, a first six sided die and a second six sided die, the first die including the numerals 1 through 6, the second die including the numerals 7 through 12, players rolling each die to determine movement of their respective pieces.

2. A quest and battle board game comprising:

a game board formed in a planar configuration and including a maze and battle side and a world map side, the maze and battle side including a plurality of rectangular spaces and a plurality of upwardly extending structures representing mazes, the world map side being formed in a planar configuration and including a plurality of inverted V-shaped structures, the world map side also including house-shaped structures, castle-shaped structures, circled numerals and other structures providing for organized movement of pieces across the board; and a plurality of character cards including information regarding the abilities of the characters of the game, at least one handbook being included with the apparatus, the handbooks providing background information and detailed instructions regarding play of the game, the game including player pieces and a random number generating device to determine movement of the pieces.

3. The apparatus as set forth in claim 2 wherein the random number generating device comprises a first six sided die and a second six sided die, the first die including the numerals 1 through 6, the second die including the numerals 7 through 12, players rolling each die to determine movement of their respective pieces.

4. The apparatus as set forth in claim 2 wherein at least one side of the game board has at least two separate halves.

5. The apparatus as set forth in claim 2 wherein the game board is formed in a generally rectangular configuration.

6. The apparatus as set forth in claim 2 wherein at least three separate handbooks are included with the game, each handbook describing the rules of play with respect to different parts of the game.

* * * * *